United States Patent [19]

Sanstrom

[11] 4,365,361

[45] Dec. 28, 1982

[54] TOILET BOWL ODOR EDUCTING AND POWERED EXHAUST SYSTEM

[76] Inventor: Grant H. Sanstrom, P.O. Box 138, Parker, Wash. 98939

[21] Appl. No.: 23,246

[22] Filed: Mar. 23, 1979

[51] Int. Cl.[3] ..... E03D 9/052

[52] U.S. Cl. ..... 4/213; 4/216

[58] Field of Search ..... 4/209, 213, 216, 217, 4/218, 219, 347–352

[56] References Cited

U.S. PATENT DOCUMENTS

| | | | |
|---|---|---|---|
| 2,238,461 | 4/1941 | Carman | 4/213 |
| 3,122,757 | 3/1964 | Sowards | 4/213 |
| 3,332,089 | 7/1967 | Wilton | 4/213 |
| 3,335,431 | 8/1967 | Coates | 4/213 |
| 3,534,415 | 10/1970 | Huffman | 4/213 |
| 3,857,119 | 12/1974 | Hunnicutt, Jr. | 4/213 |

*Primary Examiner*—Stuart S. Levy
*Attorney, Agent, or Firm*—Harvey B. Jacobson

[57] ABSTRACT

Air passage defining structure is provided including an inlet end communicated with the open upper end of the interior of a toilet bowl and an outlet end opening into a drain outlet for the toilet bowl downstream from the conventional water seal area of the toilet bowl. The drain outlet includes a venturi area into which the outlet end of the air passage defining structure opens and the normal flushing of the toilet bowl thereby causes air and odors from within the upper portion of the toilet bowl to be educted therefrom by venturi action. Also, the air passage defining structure includes an air pump serially connected therein intermediate its opposite ends and one way air valve structure also serially connected therein downstream from the air pump structure.

8 Claims, 5 Drawing Figures

TOILET BOWL ODOR EDUCTING AND POWERED EXHAUST SYSTEM

BACKGROUND OF THE INVENTION

Various forms of structures have been heretofore provided for venting objectionable odors from within toilet bowls. Some of these structures include powered ventilation systems which discharge through standpipes and while others include power ventilation systems which discharge directly to the exterior of the associated building structure. In addition, while some toilet bowl venting structures vent the interior of the toilet bowl directly to the associated drain line, these venting bowl structures are not readily attachable to the existing toilet bowl installations and do not provide adequate control against the entrance of sewer gases into the toilet bowl.

Examples of previously known forms of toilet bowl venting structures of the above type are disclosed in U.S. Pat. Nos. 940,435, 2,299,273, 2,342,714, 2,472,457, 2,685,094, 3,064,274, 3,533,112, 3,681,790 and 3,781,923.

BRIEF DESCRIPTION OF THE INVENTION

The toilet bowl odor educting and powered exhaust system of the instant invention includes structure whereby toilet bowl odors may be directly vented to the associated drain line in a manner including a powered air pump to insure only one-way air flow from the toilet bowl to the drain line during operation of the powered air motor and including one-way air valve structure for preventing reverse flow of air from the drain line into the toilet bowl when the powered air pump is not in operation.

The main object of this invention is to provide a toilet bowl venting system whereby odors from within the toilet bowl may be vented therefrom and discharged into the drain line for the toilet bowl.

Another object of this invention in accordance with the immediately preceding object, is to provide a toilet bowl venting system which will exclude the possibility of backflow ofodors from the toilet drain line into the toilet bowl.

Still another object of this invention is to provide a toilet bowl venting system in accordance with the preceding objects and which may be readily adapted to existing toilet bowls as well as included in the installation of newly installed toilet bowls.

Another very important object of this invention is to provide a powered toilet bowl vapor exhausting system which may be automatically actuated either by the electrical circuit for the lights of the associated bathroom or by a seat actuated control switch therefor responsive to downward pressure on the toilet seat.

A final object of this invention to be specifically enumerated herein is to provide a toilet bowl odor venting system in accordance with the preceding objects and which will conform to conventional forms of manufacture, be of simple construction and easy to use so as to provide a device that will be economically feasible, long lasting and relatively trouble free in operation.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
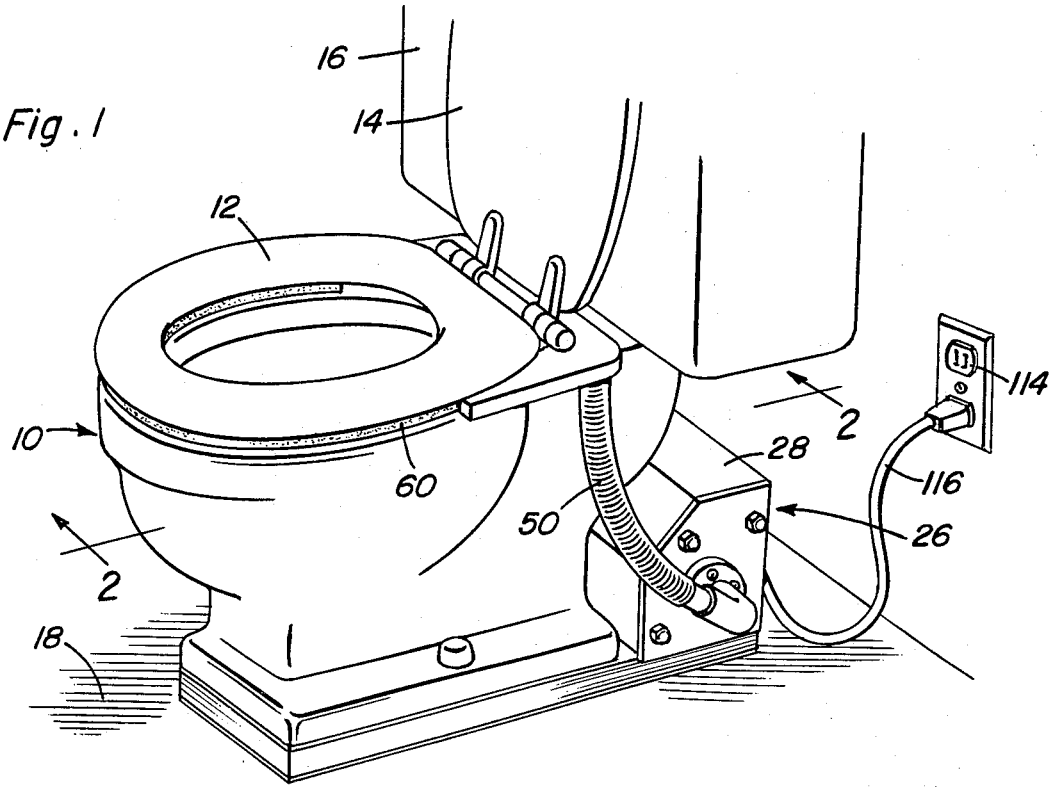
FIG. 1 is a fragmentary perspective view of a conventional form of toilet bowl with the powered exhaust system of the instant invention operably associated therewith.
Figure 3:
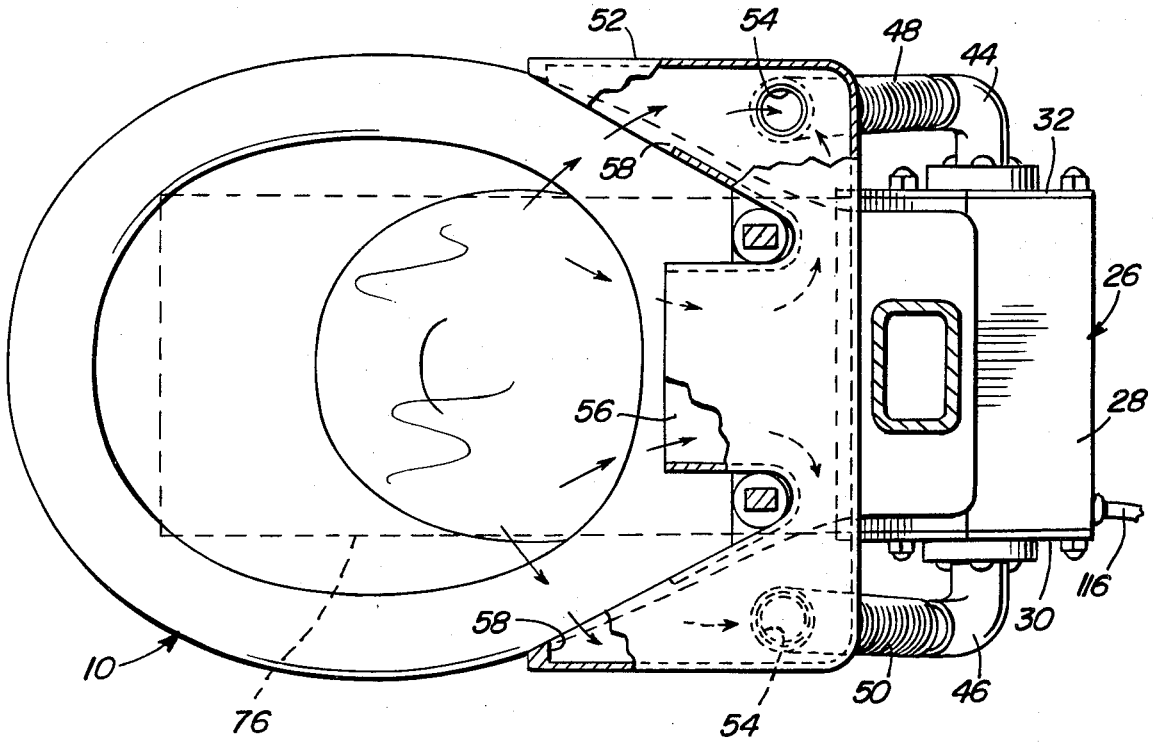
FIG. 3 is a horizontal sectional view taken substantially upon the plane indicated by the section line 3—3 of FIG. 2.
Figure 2:
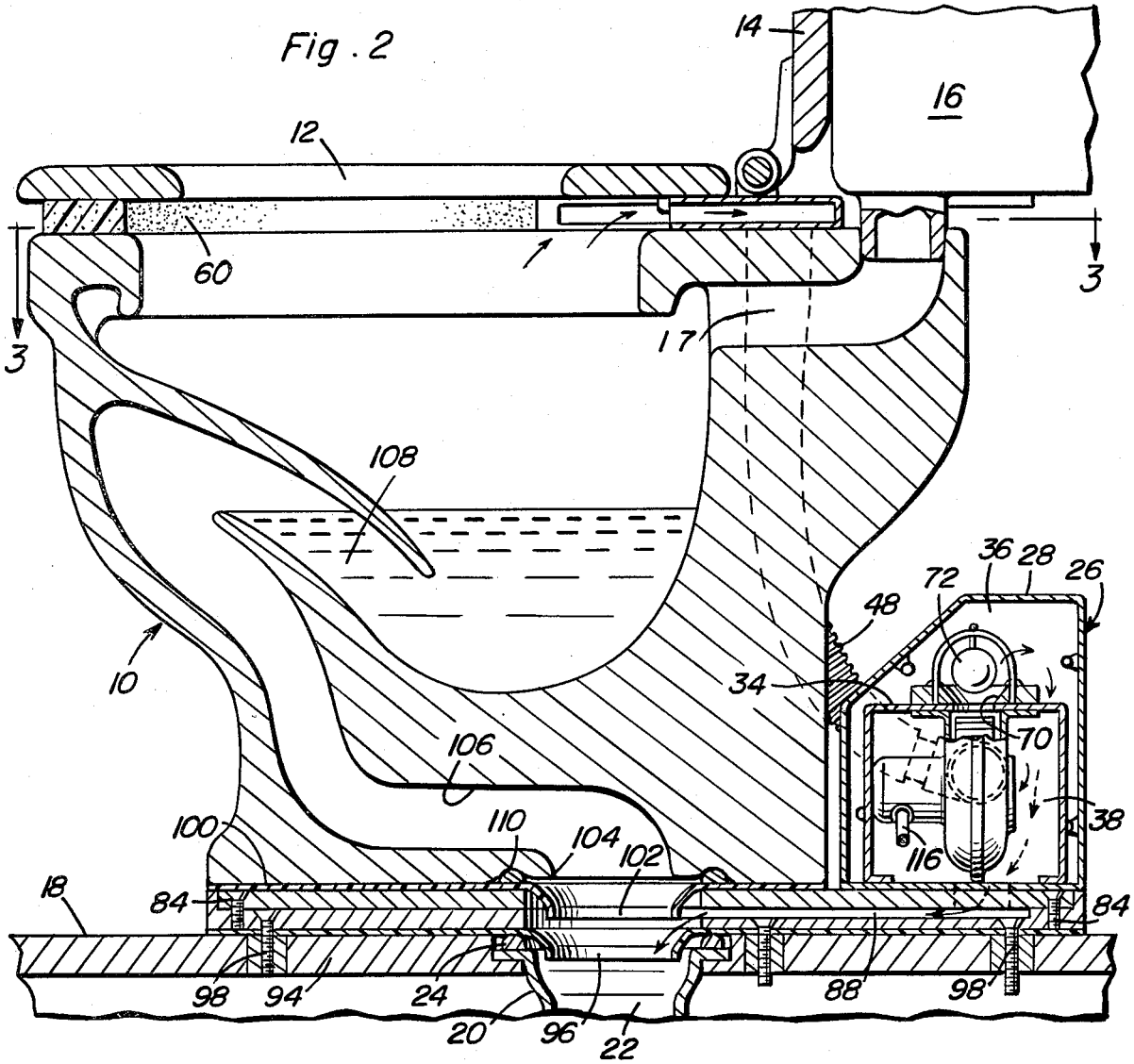
FIG. 2 is an enlarged fragmentary vertical sectional view taken substantially upon the plane indicated by the section line 2—2 of FIG. 1.
Figure 4:
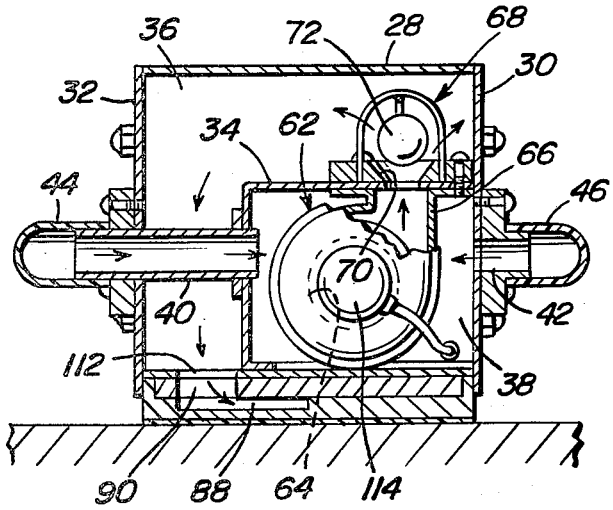
FIG. 4 is a vertical section view illustrating the interior structure of the housing portion of the invention.
Figure 5:
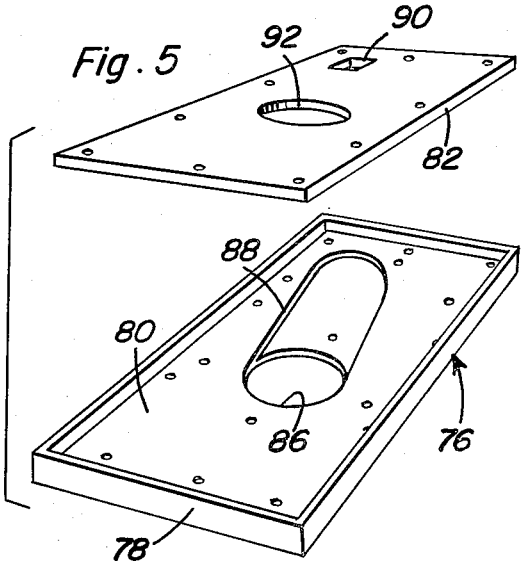
FIG. 5 is an exploded perspective view of the spacer plate structure of the instant invention to be interposed between the base of the toilet bowl and the supporting floor therefore.

Referring now more specifically to FIGS. 1 and 2 of the drawings, the numeral 10 generally designates a conventional toilet bowl assembly having a pivoted seat 12 and a pivoted seat lid 14 operatively associated therewith in the conventional flushing system manner. In addition, a conventional tank 16 is operatively associated with the toilet bowl assembly 10 in a conventional manner for discharging flushing water into the bowl assembly through flushing water passages including passage 17.

The toilet bowl assembly 10 is supported from the floor 18 of a bathroom and the bell end 20 of a drain line 22 opens upwardly through the floor 18 and has a annular wax seal 24 operatively associated therewith.

The toilet bowl odor educting and powered exhaust system of the instant invention includes a housing assembly referred to in general by the reference numeral 26. The housing assembly 26 includes an outer housing 28 having removable end walls 30 and 32 and an inner housing 34 within the outer housing 28. The outer and inner housings define outer and inner compartments 36 and 38 therewithin and the inner housing 34 includes a pair of inlets 40 and 42 to which the discharge end fittings 44 and 46 of a pair of flexible conduits 48 and 50 are communicated. An air and odor inlet shroud 52 is supported from the bowl assembly 10 at the rear of the seat 12 and includes outlets 54 to which the inlet ends of the conduits 48 and 50 are connected. The shroud 52 includes central and opposite side inlet openings 56 and 58 which open into the opposite side and rear center portions of the interior of the bowl over the upper marginal portions thereof beneath the rear portions of the seat 12 and an elongated U-shaped seal strip 60 is interposed between the upper surfaces of the opposite side and forward portions of the bowl assembly 10 and the opposing undersurfaces of the seat 12. Thus, air may be educted from the upper portion of the toilet bowl assembly 10 through the shroud 52, the conduits 58 and into the compartment 38. A motor driven blower assembly 62 is disposed within the compartment 38 and includes an inlet 64 opening into the compartment 38 and an outlet 66 communicated with the interior of the compartment 36 through an air valve assembly referred to in general by the reference numeral 68 including an upwardly facing valve seat 70 against which a caged lightweight valve member 72 is downwardly engageable to prevent a reverse flow of air from the compartment 36 into the compartment 38.

Housing assembly 38 is mounted upon the rear portion of a horizontally elongated spacer assembly referred to in general by the reference numeral 76. The spacer assembly 76 includes a lower plate 78 defining an upwardly opening recess 80 therein and closed by an upper plate 82 secured downwardly over the top of the lower plate 78 by means of suitable fasteners 84. The lower plate 78 includes a central outlet opening 86 formed therein and the bottom of the recess 80 includes an elongated groove 88 formed therein with one end of the groove 88 terminating in one corner portion of the lower plate 78 immediately beneath and in registry with an inlet opening 90 formed in the corresponding corner portion of the upper plate 82. Also, the upper plate 82 includes a central opening 92 formed therethrough in registry with the outlet opening 86 in the lower plate 78.

When installing the spacer assembly 76, the toilet bowl assembly 10 is loosened from the floor 18 in the conventional manner and a sheet 94 of plastic is disposed over the floor 18 and has a central opening 96 therein registered with an opening downwardly into the drain pipe 22 over the wax seal 24. After the sheet 94 of plastic has been positioned, the spacer assembly 76 is placed thereover in the manner illustrated in FIG. 2 of the drawings and secured to the floor 18 by means of suitable fasteners 98. A second sheet 100 of plastic having a central opening 102 formed therein is disposed over the spacer assembly 76 with the opening 102 registered with the opening 96 in the drain pipe 22 and the outlet 104 of the drain passage 106 of the toilet bowl assembly 10, see FIG. 2. It will be noted that the toilet bowl assembly 10 is of a conventional type including a water seal area 108.

The openings 96 and 102 are defined by tapered neck portions of the central areas of the sheets 94 and 100 and after the sheet 100 has been adjusted in position, a second annular wax seal 110 is disposed over the sheet 100 and the toilet bowl assembly 10 is disposed over the sheet 100 and secured to the floor in the conventional manner by means of the conventional toilet bowl hold-down screws which pass through openings provided therefor in the lower and upper plates 78 and 82 of the spacer assembly 76. The groove 88 and opening 90 define means for communicating the outlet 112 of the outer housing 28 and compartment 36 with the drain pipe 22 between the necks defining the openings 96 and 102.

The blower assembly 62 includes an electrically actuated driving motor 114 and the driving motor may be electrically communicated with a suitable source of electrical potential such as a wall plug 114 within the associated bathroom by means an extension cord 116. The wall plug 114 may be under the control of a wall switch also controlling the lighting for the associated bathroom. Also, the wall plug 114 may be of the type which has a constant supply of electrical potential connected thereto and the extension cord 116 may have a pushbutton on-off switch serially connected therein with the on-off switch mounted on the upper surface of the toilet bowl assembly 10 for actuation by an in response to slight downward movement of the seat 12 as a result of a person being seated thereon.

In operation, when the blower assembly 62 is actuated air is drawn from the upper portion of the interior of the toilet bowl assembly 10 through the shroud 52 and the conduits 48 and 50 into compartment 38 of the inner housing 34. The air then passes into the blower assembly 62 through the inlet 64 and outwardly from the blower assembly through the outlet 66. The pressure differential on opposite sides of the valve member 72 causes the latter to be blown upwardly and thus unseated from the seat 70 and to thereby allow air being discharged from the outlet 66 of the blower assembly 62 to enter the compartment 36 of the outer housing 28 and to be discharged therefrom through the outlet 112 for the housing 28 into the groove 88 formed in the lower plate 78 of the spacer assembly 76. The discharged air then passes through the groove 88 and into the drain line from between the necks 96'and 102. Of course, any time the blower assembly 62 is not in operation, the valve member 72 will fall by gravity back down into seated engagement with the seat 70 and thus prevent reverse flow of air or sewer odors through the air passage structure communicating the interior of the shroud 52 with the groove 88. Further, even if the blower assembly remains inactive, when the toilet bowl assembly 10 is flushed with water from the tank 16, the rapid flow of a larger quantity of water from within the bowl through the opening 102 and the associated neck and through the opening 96 and associated neck a zone of reduced pressure is defined between the necks 96 and 102 and this reduced pressure is experienced in the groove 38, the opening 90, the outlet 112 and the compartment 36 thereby creating a differential pressure on opposite sides of valve member 72 whereby the latter will be upwardly displaced from its seated position against the seat 70 and air will be drawn through the blower assembly 62, the compartment 38 and the conduits 48 and 50. Thus, even when the blower assembly 62 is inoperative, odors from within the toilet bowl assembly 10 will be educted therefrom whenever the toilet bowl assembly 10 is flushed by water from the tank 14.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination with a toilet bowl having a water seal-type drain outlet communicated with a drain line and a bowl flushing system including flushing water passage means for passing flushing water from a supply thereof into the interior of said bowl, housing means defining first and second closed compartments, said housing means including inlet means opening into said first compartment, means communicating said inlet means with the interior of said bowl independent of said flushing water passage means, passage means communicating the interiors of said compartments, said housing means including outlet means for said second compartment communicating with said drain line downstream from said water seal, said inlet means, compartments, passage means and outlet means defining an air passage communicating the interior of said bowl with said drain line, said air passage means including one-way air valve means operative to permit airflow through said air passage in one direction from said inlet means to said drain line and to prevent airflow through said air passage in the opposite direction, said one-way air valve being mounted inside second compartment on the exterior surface of said first compartment and being connected to said passage means communicating the interior of said compartments, and selectively operable air pump means serially connected in said air passage for pumping air therethrough in said one direction, said air pump means being disposed in said first compartment and said first compartment being enclosed within said second compartment.

2. The combination of claim 1 wherein said air valve is disposed downstream from said air pump means.

3. The combination of claim 1 wherein said air pump means includes an electrically actuated motor and blower assembly.

4. The combination of claim 1 wherein said drain line includes a venturi area thereof into which said air passage means opens.

5. The combination of claim 4 wherein said air valve means is operative to permit said airflow in said one direction in response to only slightly less air pressure on the downstream side of said air valve.

6. The combination of claim 1 wherein said toilet bowl includes a seat hingedly supported therefrom for overlying the upper open end of the toilet bowl in vertically spaced relation relative thereto, said inlet means including an inlet shroud having vertically thin inlet portions opening into the space between the rear of said seat and the opposing rear upper surfaces of said bowl.

7. The combination of claim 6 including a seal strip interposed between the opposite side and forward downwardly spacing under surfaces of said seat and the opposing upwardly spacing surfaces of said toilet bowl.

8. The combination of claim 1 wherein said passage means communicating the interiors of said compartments defines an upwardly opening seat and said air valve means comprises a caged lightweight valve member downwardly seated against said seat.

* * * * *